US005568854A

United States Patent [19]

Hayes et al.

[11] Patent Number: 5,568,854

[45] **Date of Patent: * Oct. 29, 1996**

[54] COIN DISCRIMINATION METHOD

[75] Inventors: Stephen J. Hayes, Swansea, England; Patrick R. Gorman, Lakeland, Fla.

[73] Assignee: Protel, Inc., Lakeland, Fla.

[ * ] Notice: The term of this patent shall not extend beyond the expiration date of Pat. No. 5,351,798.

[21] Appl. No.: 317,796

[22] Filed: Oct. 4, 1994

Related U.S. Application Data

[60] Continuation-in-part of Ser. No. 27,363, Mar. 8, 1993, Pat. No. 5,351,798, which is a division of Ser. No. 722,480, Jun. 28, 1991, Pat. No. 5,191,957.

[51] Int. Cl.[6] ..... G07D 5/08

[52] U.S. Cl. ..... 194/318; 194/319

[58] Field of Search ..... 194/318, 319, 194/317

[56] References Cited

U.S. PATENT DOCUMENTS

| | | | |
|---|---|---|---|
| 3,653,481 | 4/1972 | Boxall et al. . | |
| 3,739,895 | 6/1973 | Fougere et al. . | |
| 4,286,704 | 9/1981 | Wood | 194/318 |
| 4,353,452 | 10/1982 | Shah et al. . | |
| 4,460,080 | 7/1984 | Howard . | |
| 4,471,864 | 9/1984 | Marshall . | |
| 4,488,116 | 12/1984 | Plesko | 324/236 |
| 4,678,994 | 7/1987 | Davies | 194/317 X |
| 4,742,903 | 5/1988 | Trummer | 194/317 |
| 4,754,862 | 7/1988 | Rawicz-Szczerbo et al. | 194/319 |
| 4,951,799 | 8/1990 | Kai | 194/317 |
| 5,007,520 | 4/1991 | Harris et al. | 194/317 |
| 5,158,166 | 10/1992 | Barson | 194/319 |
| 5,351,798 | 10/1994 | Hayes | 194/318 |

FOREIGN PATENT DOCUMENTS 0072189 3/1982 European Pat. Off. .

*Primary Examiner*—F. J. Bartuska

*Attorney, Agent, or Firm*—Allen, Dyer, Doppelt, Franjola & Milbrath, P.A.

[57] ABSTRACT

An electronic coin detector and method for sensing the presence of a valid coin and for providing an indication of the valid coin's type. A coin is guided into position between a first set of inductor coils. The coin is then guided through a channel surrounded by a second inductor coil. A first oscillating signal is then fed to the first set of inductor coils and a second higher frequency oscillating signal is fed to a second inductor coil. An altered signal is then provided in response to the effect of the coin passing through the inductor coils. After the coin has passed adjacent one of the inductor coils, the inductor coils are fed a calibration signal to produce a calibrated signal. This calibrated signal is then used to scale the altered signal. The frequency, amplitude, and amplitude-time characteristics of the scaled altered signal for the first set of inductor coils and the second inductor coil are combined with prestored statistical variables corresponding to frequency, amplitude, and amplitude-time characteristic values of a sample of valid coins. The combined results are then compared to determine if the deposited coin is valid. If the coin is valid, the combined results are compared with the prestored statistical variables to determine the coin's type.

4 Claims, 5 Drawing Sheets

COIN DISCRIMINATION METHOD

This application is a continuation-in-part of application, Ser. No. 08/027,363 filed Mar. 8, 1993, now U.S. Pat. No. 5,351,798, which is a division of application Ser. No. 07/722,480 filed Jun. 28, 1991, now U.S. Pat. No. 5,191,957.

BACKGROUND OF THE INVENTION

This invention relates to a method and apparatus for electronically determining the acceptability of a coin. More particularly, this invention relates to an apparatus that determines the validity and value of a coin as the coin passes through an electromagnetic field.

In the prior art it is known to insert coins through a coin detection device having an inductive electromagnetic field. The effect upon field variation as the coin passes through the electromagnetic field is detected by sensing frequency and/or amplitude changes of an oscillating electrical signal through the inductors. Characteristics of the oscillating signals are then compared with data stored in a programmable memory. If these characteristics are within the predetermined limits for acceptable coins of a given denomination, then the apparatus indicates that the coin is acceptable. Examples of devices that measure coins and determine whether they are within predetermined limits of an acceptable value are disclosed in U.S. Pat. Nos. 3,918,565 to Fougere et al. and 3,653,481 to Boxall et al.

A drawback to the devices disclosed in the aforementioned patents is that only certain physical characteristics of the coin, such as the coin's diameter or thickness, may be detected by the device. When a coin is bent or chipped, many of the characteristics of the oscillating signals for the coin being detected could be inaccurate. Thus, when the detection device detects these inaccuracies, the coin could wrongfully be rejected. Further, if the parameters being detected are of a fraudulent coin, generally referred to as a "slug," have the same characteristics as an acceptable coin, the "slug" could be accepted by the device.

Techniques for overcoming the aforementioned limitations are disclosed in U.S. Pat. Nos. 4,353,452 to Shah et al., 4,742,903 to Trummer, and 4,754,862 to Rawicz-Szczerbo et al. These patents disclose a technique of feeding a coin successively and simultaneously through multiple high-frequency test signals to obtain more than one characteristic of the coin. However, certain characteristics of the coin may still not be detected, and a slug could wrongfully be accepted.

Techniques have been proposed for measuring more than one parameter of a moving coin. An example of such a technique is disclosed in U.S. Pat. No. 4,488,116 to Plesko. This technique places a coin between two different electromagnetic fields and then measures the coin's interaction on the field. However, this technique may not be able to detect all the characteristics of the coin, allowing the possibility of a slug being accepted.

Another drawback to prior art coin detection devices is that when the characteristics of the oscillating signal being measured are close to the characteristics of the oscillating signal for the coins that are acceptable, the coin-detecting device may not be able to distinguish an acceptable coin from an unacceptable coin. Further, the coin detection device's sensitivity may change with aging or with room temperature changes. Consequently, the detection of the characteristics of the oscillating signal could become inaccurate, resulting in an increase in the uncertainty of coin detection.

Most of the aforementioned techniques convert the detected characteristic into a numeric value and then preselect a value or a range of values for each coin that is acceptable. If the numeric value of the characteristics of the oscillating signal falls outside this range, the coin will be rejected. Thus an otherwise acceptable coin may be rejected, where one physical characteristic does not conform with an acceptable limit.

Due to aging and temperature variations of the coin detection device, it may be necessary to have the device calibrated. Examples of calibration techniques are disclosed in U.S. Pat. No. 4,471,864 to Marshall and Great Britain 024,398. Great Britain 024,398 discloses a technique for calibrating a range of values for each coin that allows the coin to be accepted. However, these calibration techniques set fixed limits on the range of values in which the coin's characteristics must be within. Consequently, a valid coin that has values that are close to the range, but outside the limits, may be inadvertently rejected.

Another technique for calibrating the coin detection device is disclosed in U.S. Pat. No. 4,471,864. This device uses a reference oscillator that is continuously in operation. The reference oscillator generates correcting signals that are fed back to a main oscillator to maintain the main oscillating output at a constant amplitude. This calibration circuit provides correcting signals to maintain the output for each coin at a constant repeatable value. However, if the oscillator circuits vary due to aging, the circuit could generate inaccurate outputs. Thus, this coin detector could provide a faulty indication.

SUMMARY OF THE INVENTION

An objective of this invention is to provide an improved apparatus and method for electronically detecting acceptable coins.

Another objective of this invention is to measure multiple parameters of the coin being detected to more accurately sense the coin's parameters.

A further objective of this invention is to form a statistical sampling of each coin type so that an unacceptable characteristic will not necessarily reject the coin if all of the other characteristics of the coin are acceptable.

It is also an objective of this invention to provide means for calibrating the inductor coil through which the coin passes to compensate for aging and temperature variations of the coin-detecting circuitry.

An additional objective of this invention is to provide a method for detecting statistical variations of the different characteristics of a coin as sensed by the effect of a coin passing through an electromagnetic field and using these statistical variations to determine whether the coin is acceptable.

A further objective of the invention is a method of determining a mean and standard variation of numeric values for various characteristics of a coin and combining differences between the detected coin's value and the prestored mean and standard deviation numeric values to indicate both whether or not the coin is acceptable and the value of the coin.

An additional objective of the invention is to measure multiple characteristics of a coin by passing a coin through a plurality of electromagnetic fields.

These and other objectives are provided with a coin detection method that establishes a magnetic flux across a coin path. A coin is then passed along the path, and changes in the inductance and energy loss caused by the presence of the coin are detected. Both changes are utilized for the detection of a coin having predetermined characteristics, and a signal is provided indicating the coin's acceptability in response to both changes being detected.

Alternatively, the invention may be practiced with an electronic coin detector comprising a path in which a coin travels from a first end to a second end. One or more of parallel coils are provided such that as the coin travels along the path, the coin passes adjacent the coils. When more than one coil is used, the coils are disposed parallel to each other and parallel to the coin, and the coils are wired in series. Another inductor coil surrounds a channel through which the coin passes. Means is provided that feeds an oscillating signal to the first pair of inductor coils and provides a first oscillating signal in response to the effect of the coin passing adjacent the coils. The detector further includes means for providing a second oscillation signal to the other inductor coil and for providing a second altered oscillating signal in response to the effect of a coin passing through the channel. Means responsive to the first and second altered signals indicates when the coin is acceptable. This configuration permits the detector to sense multiple characteristics of a coin and to more accurately determine the coin's value.

According to another aspect of the invention, a method for determining whether or not a coin is acceptable is provided comprising the steps of generating a universal coin table of statistical variables at the factory, measuring the electrical signals in response to a coin to be detected, and calculating the statistical variations of the electrical signals from the stored statistical variables to determine if the coin is a valid coin type. A characterization is done at the factory by dropping a large number of each coin type to be detected in many coin detectors and recording the values for the electrical characteristics. The statistical variables are then calculated for the electrical characteristics and stored in memory as a universal coin table for all coin detectors. The system is now ready to measure/detect coins. When a coin is measured, a signal is provided having electrical characteristics corresponding to the physical characteristics of the measured coin. The statistical variations of the provided signal from the stored statistical variables are calculated for each coin type, and an indication of acceptance is provided if the RMS (root mean square) sum of all of the statistical variations for a given coin type is less than a predetermined value.

In another embodiment of the invention, an electronic coin detector is provided that comprises means for providing a calibration signal to inductor coils that produces a response similar to the response produced when a coin passes by the coils, but the calibration signal is applied when no coin is present in the coils. The coin detector has means to scale the response produced when a coin passes by the coils, and the scaling factors are the calibration response and the idle condition or no coin response. By continuously scaling the electronic signals in accordance with the referenced electronic signal's characteristics, the coin detector may be continuously calibrated, thus preventing inaccuracies due to changing temperature or other environmental conditions.

In a further embodiment of the invention, changes in the inductance and energy loss caused by movement of the coin are detected, and these changes are utilized to determine an amplitude characteristic. The time rate of change of this amplitude characteristic can also be used to determine the acceptability of the coin under test.

Another advantage of the present system is the method used to detect a coin is present so coin measurements can be started. Instead of using an additional start-up coil (or sensor), the first coil is included which has the function of sensing physical measurements of a coin and sensing the coin is present. As a coin just begins to enter the first coil, the first coil provides a correction signal that increases in amplitude. This increase is detected to start-up the coin measurement process.

DESCRIPTION OF THE PREFERRED EMBODIMENTS

Figure 1:
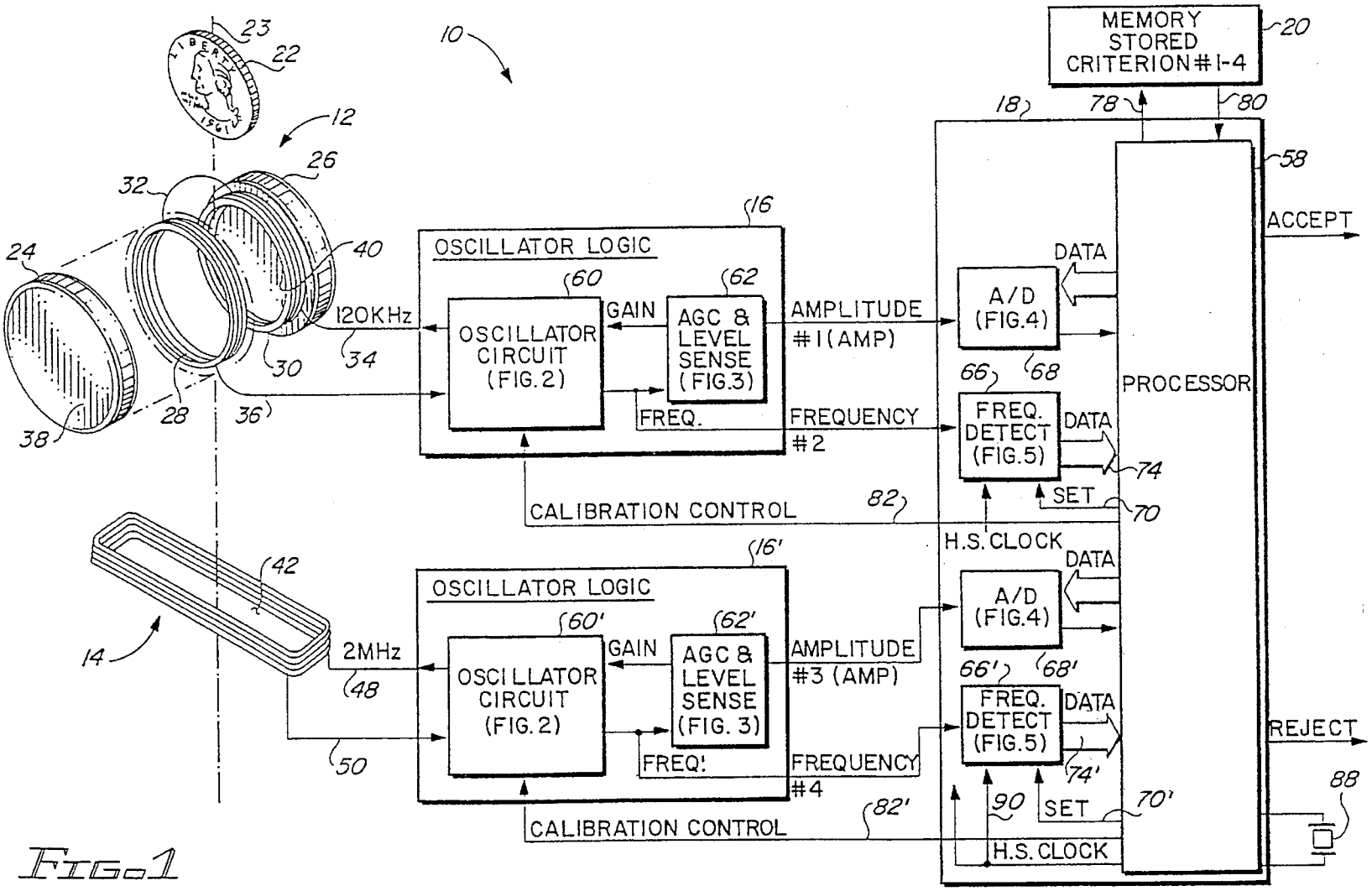
FIG. 1 is a block diagram of the device showing a coin passing through two different coil types, and a pair of oscillators each connected to a different coil type providing signals to a microprocessor for storage and memory.

Referring to FIG. 1 there is shown a simplified schematic diagram for detection apparatus 10 comprising induction devices 12 and 14, each coupled through oscillator logic 16 and 16' to processor logic 18. Processor logic 18 is coupled to memory 20 and provides an ACCEPT or REJECT signal in response to a coin 22 passing through induction devices 12 and 14.

Induction device 12 includes a first coil core 24 and third coil core 26. It is preferable that cores 26 be constructed with a ferrite disk. Adjacent and parallel to coil cores 24 and 26 are first and third inductor coils 28 and 30, respectively. Coils 28 and 30 are preferably sixty turns each and are electrically connected together via shunt wire 32. Although not required, coil core 26 may be included to shield the coils from electromagnetic radiation and concentrate the effect of coins on the coils' oscillation. Third inductor coil 30 has an input 34 electrically connected to output 36 on first inductor coil 28. Both coil cores 24 and 26, along with inductor coils 28 and 30, have parallel, opposingly facing inner surfaces 38 and 40. Surfaces 38 and 40 are spaced apart at a distance selected such that coin 22 may pass between the two coils. It is preferable that the diameter of coil cores 24 and 26 exceed the diameter of inductor coils 28 and 30 and that the diameter of inductor coils 28 and 30 exceed the largest diameter of acceptable coins 22.

During operation, coin 22 travels along path 23 and passes between inductor coils 28 and 30 into a channel or channel 42 within induction device 14. Induction device 14 is preferably constructed using techniques similar to those disclosed in U.S. Pat. No. 3,587,809 to Meloni and has a twenty-turn second inductor coil 44 with input 48 and an output 50. Channel 42 is wide enough to accept the largest acceptable coin such that when coin 22 travels along path 23 it can pass through channel 42.

Induction devices 12 and 14 are coupled to oscillator logic 16 and 16', respectively. When no coins are present along path 23, oscillator logic 16 provides less than 1 MHz, and is preferably a 120 kHz oscillating signal to inductively induce a magnetic field or flux in induction device 12. Oscillator logic 16' provides a high frequency above 1 MHz, preferably a 2 MHz oscillating signal to inductively induce a magnetic field in induction device 14. Oscillator logic 16 and 16' include oscillator circuits 60 and 60' coupled to an Automatic Gain Control (AGC) and level sense circuits 62 and 62'. The oscillating signal originates with oscillator circuit 60 and is controlled by AGC and level sense circuit 62. Oscillator logic 16 feeds the frequency of the oscillation on output 36, herein referred to as Characteristic No. 2, to frequency detector circuit 66 within processor logic 18. Oscillator circuit 60' within oscillator logic 16' feeds the frequency of oscillation on output 50, herein referred to as Characteristic No. 4, from induction device 14 to frequency detector circuit 66' within processor logic 18. These signals, hereafter referred to as FREQ and FREQ', are also fed to circuit 62 and 62'.

Circuit 62 feeds a GAIN control signal to oscillator circuit 60 in response to FREQ signal. An AMP signal indicating the amplitude correction factor of FREQ, herein referred to as Characteristic No. 1, is fed by circuit 62 within oscillator logic 16 to an analog-to-digital (A/D) converter circuit 68 within processor logic 18. Another signal AMP indicating the amplitude correction factor of FREQ', herein referred to as Characteristic No. 3, is fed by circuit 62' within oscillator logic 16' to converter circuit 68'.

In processor logic circuit 18, processor 58 is fed digitized data from A/D converter circuit 68 indicating the amplitude correction factor of the oscillation on induction device 12 (Characteristic No. 1). An A/D converter circuit 68' feeds processor 58 a digital data signal corresponding to the amplitude correction factor of the oscillation on induction device 14 (Characteristic No. 3).

In an alternate embodiment, in communication with processor 58 is timer 102, which may be used to provide additional Characteristics Nos. 5 and 6 from, respectively, the time rates of change of Characteristics Nos. 1 and 3, the amplitude correction factors. Timer 102 may comprise a timer available in a microprocessor or microcontroller, or an external real time clock or timer circuit. As a coin 22 passes through induction devices 12 and 14, Characteristics Nos. 1 and 3 rise from a steady-state value to a peak value when the coin 22 is in the center of coils 28 and 30 (Characteristic No. 1) and coil 44 (Characteristic No. 3). The times required to reach peak amplitude (Characteristics Nos. 5 and 6, respectively) are proportional to the diameter of coin 22.

Frequency detector circuit 66, when selected from processor 58 on line 70, feeds processor 58, a digital signal on data lines 74 indicating Characteristic No. 2. Frequency detector circuit 66' feeds processor 58 when selected on select line 70' a data signal on line 74' indicating Characteristic No. 4. Processor 58 communicates with memory 20 through lines 78 and 80 to store and reference frequency, amplitude, and amplitude-time characteristics data corresponding to the mean and standard deviation of Characteristics Nos. 1–6 of acceptable coins. The means and standard deviation are referred to as statistical variables.

Details of how the statistical variables are computed will be explained later. Processor 58 compares the statistical variables through a series of steps which will also be explained in more detail in connection with FIGS. 6 through 8. Processor 58 provides an ACCEPT or REJECT signal when coin 22 passes through both induction device 12 and induction device 14. When an ACCEPT signal is provided, processor 58 also indicates the value of the coin which has been accepted. The value of the coin is computed by first comparing each of the Characteristics, Nos. 1 through 6, with the stored statistical variables in memory 20, and second, by determining which coin type's statistical variables most closely match Characteristics Nos. 1 through 6.

Processor 58 also provides calibration signals on calibration control lines 82 and 82' to oscillator logic 16 and 16', respectively. Calibration signals place oscillator circuit 60 in a known state so that a reference electronic signal is provided from oscillator logic 16 and a reference electronic signal is provided from oscillator logic 16' to processor 58. Processor 58 then measures AMP using the signals fed from A/D converter circuit 68 and 68' in response to the reference electronic signals. Processor logic 18 also contains clock 88 which provides a high-frequency digital clock signal to frequency detector circuits 66 and 66' via line 90.

Figure 2:
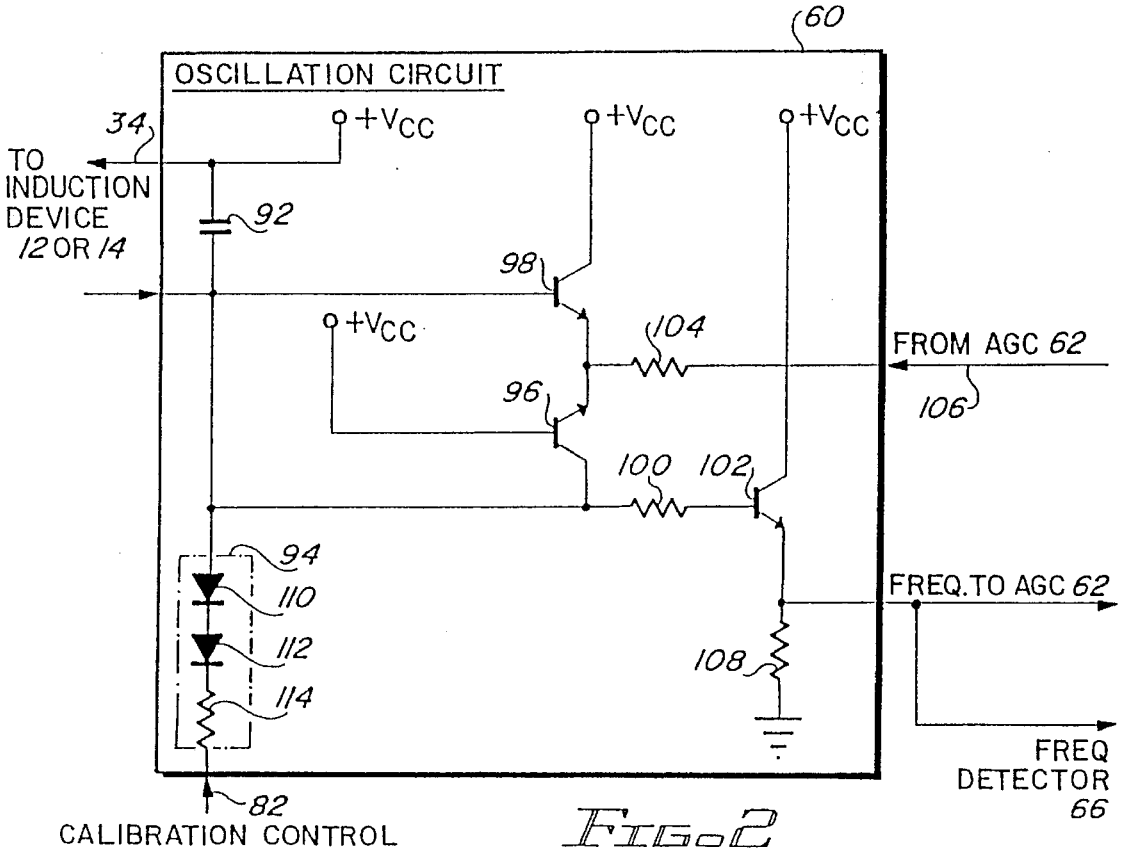
FIG. 2 is a schematic diagram of the oscillation circuit shown in FIG. 1.

Referring to FIG. 2 there is shown oscillator circuit 60 that is disposed within oscillator logic 16 or 16'. These oscillatory circuits within oscillator logic 16 or 16' are substantially identical, and accordingly only one will be explained in detail. However, the differences between the oscillator circuits within oscillator logic 16 and oscillator logic 16' will be explained.

Oscillator circuit 60 is coupled through input 34 and output 36 to induction device 12. Disposed across input 34 and output 36 is capacitor 92. When used with induction device 12 the value of capacitor 92 for oscillator circuit 60 is 3300 picofarads. The value of capacitor 92 of oscillator circuit 60 when coupled to induction device 14 is preferably 330 picofarads. Input 34 is coupled directly to $+V_{cc}$. Preferably $+V_{cc}$ equals 5 volts; however, the voltage level $+V_{cc}$ may be adjusted to accommodate different circuit conditions.

Output 36 is coupled to calibration control circuit 94, collector terminal of transistor 96, the base terminal of transistor 98 and the base terminal through resistor 100 of transistor 102. Signals fed on output 36 bias transistor 98 as well as transistor 102. Emitter terminal of transistor 98 and transistor 96 are biased through resistor 104 by a signal from sense circuit 62 on line 106. The emitter terminal of transistor 102 is coupled through resistor 108 to ground and provides a FREQ signal to sense circuit 62 and frequency detector circuit 66 in response to the oscillation signal on output 36. Transistors 96 and 98, in connection with the biased level fed on line 106 from sense circuit 62, control the amplitude of the oscillation signal on line 36.

Calibration control circuit 94 includes a plurality of diodes 110 and 112 coupled in series through resistor 114 to calibration control line 82. In response to a digital low voltage signal fed on a calibration control line 82, the amplitude of the signal FREQ starts to decrease, but AGC circuit 62 maintains a constant oscillator amplitude at FREQ by controlling the signal at line 106. The calibrated amplitude correction factor (Characteristic No. 1) is fed from the AGC circuit 62 to the A/D converter 68 and is read by processor 58. When a digital high voltage is fed on calibration control line 82, calibration control circuit 94 is effectively removed from the circuit. Accordingly, the amplitude of the oscillation on output 36 or output 50 is fed as a FREQ or FREQ' signal to sense circuit 62 or 62' and frequency detector circuit 66 or 66', respectively.

Figure 3:
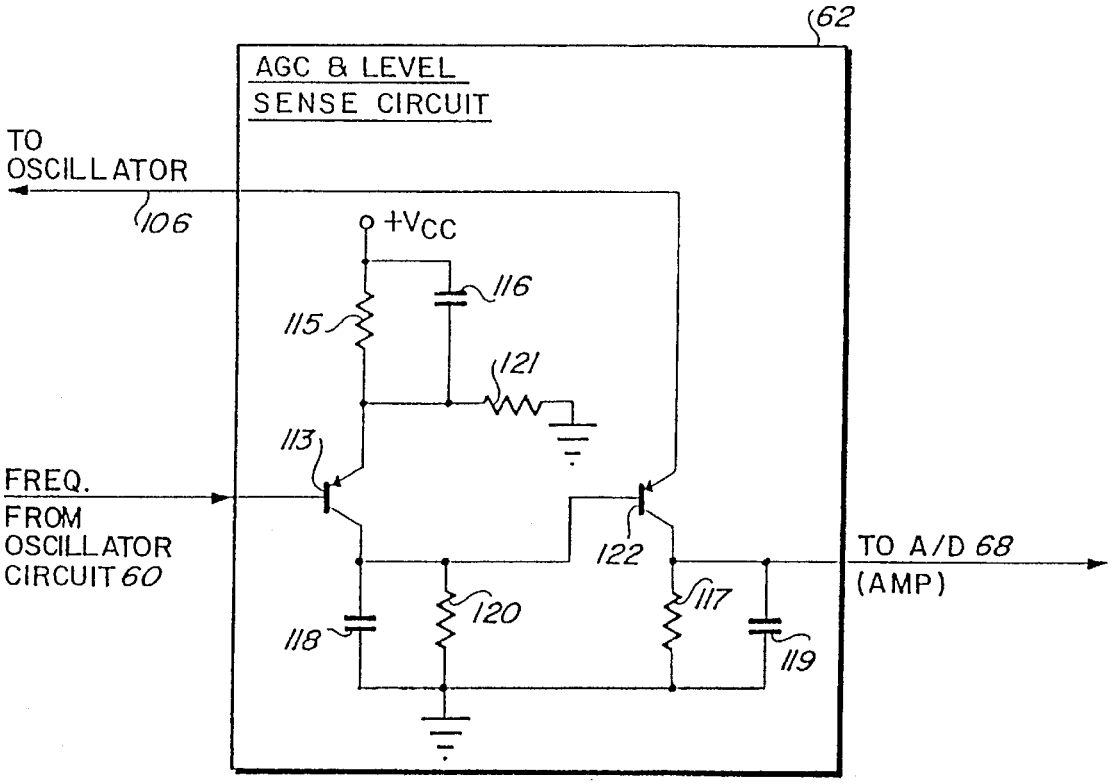
FIG. 3 is a block diagram of the automatic gain control circuit shown in FIG. 1.

Referring to FIG. 3 there is shown an AGC and level sense circuit 62 for controlling of the amplitude of oscillation signal fed to induction device 12 or induction device 14. This circuit includes transistor 113 which is fed FREQ from oscillator circuit 60 to bias transistor 113. The emitter terminal of transistor 113 is coupled through resistor 115 and capacitor 116 to $+V_{cc}$, and resistor 121 to ground. The collector terminal of transistor 113 is coupled to ground through capacitor 118 and resistor 120 and biases transistor 122. The collector terminal of transistor 122 is coupled to ground through resistor 117 and capacitor 119 and provides an AMP signal to A/D converter circuit 68 and processor logic 18. The emitter of transistor 122 is fed to oscillator circuit 60 through line 106 to maintain a constant voltage on the oscillating signal fed from oscillator circuit 60 to the induction devices 12 or 14.

Figure 4:
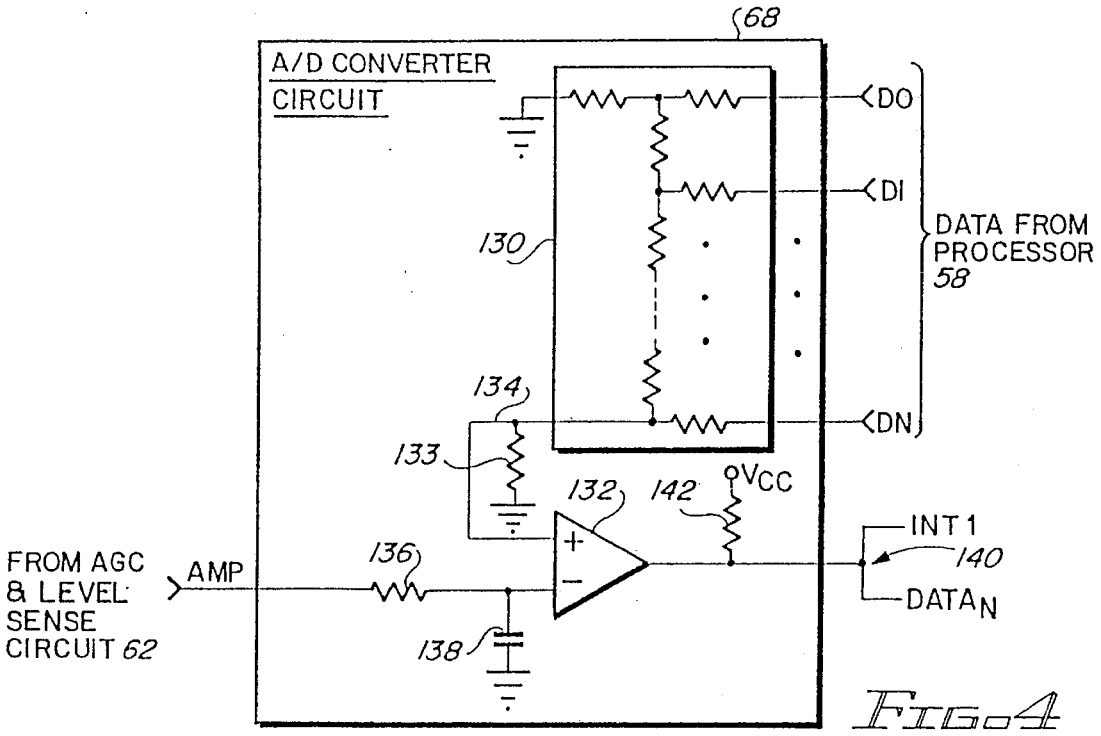
FIG. 4 is a schematic diagram of the analog-to-digital converter shown in FIG. 1.

Referring to FIG. 4 there is shown an A/D converter circuit 68 having a voltage divider network 130 with an output line 134 coupled to the positive input terminal of comparator 132 and to ground through resistor 133. Voltage divider network 130 is fed digital high and low signals from processor 58 on data lines $D_O$ through $D_N$. The amount of data lines $D_O$–$D_N$ is preferably eight, however any number of lines may be accommodated to provide various degrees of resolution of the A/D converter circuit 68. It is preferable that the varieties in the values of the resistors in voltage divider 130 be maintained less than 2% to maintain repeatability and accuracy of coin detection. Voltage divider network 130 includes a plurality of network resistors which feed a voltage level on output line 134 in accordance with the digital signal on lines $D_O$ through $D_N$.

The negative terminal of comparator 132 is coupled in series through resistor 136 to sense circuit 62, and receives the AMP signal. The negative terminal of comparator 132 is also coupled through capacitor 138 to ground. Capacitor 138 filters out high frequency components of this AMP signal. Comparator 132 compares the signal on line 134 with the level of AMP. When the voltage level of AMP exceeds the voltage level on line 134, a logic level O or low signal is fed on line 140 to interrupt one on processor 58. Line 140 is also coupled to processor 58 as a data bit. Line 140 is preferably coupled through pull up resistor 142 to $+V_{cc}$.

Figure 5:
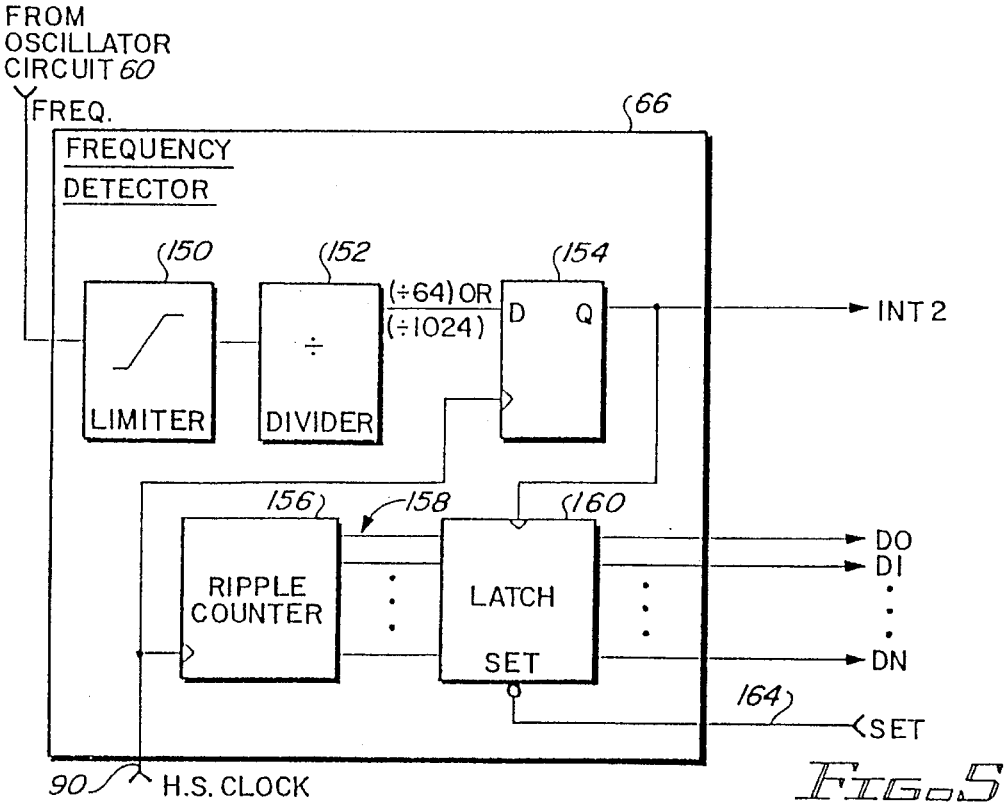
FIG. 5 depicts the frequency detector circuitry shown in FIG. 1.

Referring to FIG. 5 there is shown frequency detector circuit 66 having a limiter 150 that receives a FREQ signal from oscillator circuit 60 and converts that FREQ from a sine wave to a square wave. Limiter 150 feeds the square wave signal to divider 152 which provides approximately 2 kHz output to D–Q latch 154. This 2 kHz output is a division of the signal fed from limiter 150. More particularly, when the FREQ signal is fed from oscillator logic 16, divider circuit 152 divides the FREQ signal by 64. When FREQ' signal is fed from oscillator logic 16', divider circuit 152 divides this FREQ' by 1024.

Also, within frequency detector circuit 66 is ripple counter 156 which is coupled through output lines 158 to latch 160. Ripple counter 156, as well as D–Q latch 154, are clocked by a high-speed clock, preferably 895 kHz fed from line 90 by clock 88. Ripple counter 156 runs continuously resulting in a count-up signal being present on lines 158. These count-up signals are latched onto data lines $D_O$ through $D_N$ with latch 160 when selected on line 164. These signals are latched into latch 160 on the rising edge of the signal from divider 152. An interrupt two is provided to processor 58 on the rising edges of the 2 kHz signal. Details of processor's 58 response to this interrupt two will be discussed later in connections with FIGS. 6 through 8.

Latch 160 responds to this rising edge of this 2 kHz signal and select line 164 becoming active by feeding data on lines $D_O$ through $D_N$ corresponding to the count on ripple counter 156. Processor 58 will then sample data lines $D_O$ through $D_N$ and then wait for another interrupt two to occur. When a second interrupt two occurs corresponding to the next rising edge of the 2 kHz signal, processor 58 again reads data lines $D_O$ through $D_N$. Processor 58 then subtracts the first set of data from the second set of data to determine a count which corresponds to the period of the FREQ.

Prior to production of detection device 10, one or more coins of each coin type is deposited through inductor devices 12 and 14 and the electrical characteristics are determined. A mean and standard deviation are computed based on the electrical characteristics of the coin sampled with each coin type. The computed mean and standard deviation are then stored into a lookup table by coin type. The coin's electrical characteristics may also be determined analytically based on known thicknesses and material properties of the coin.

Figure 6:
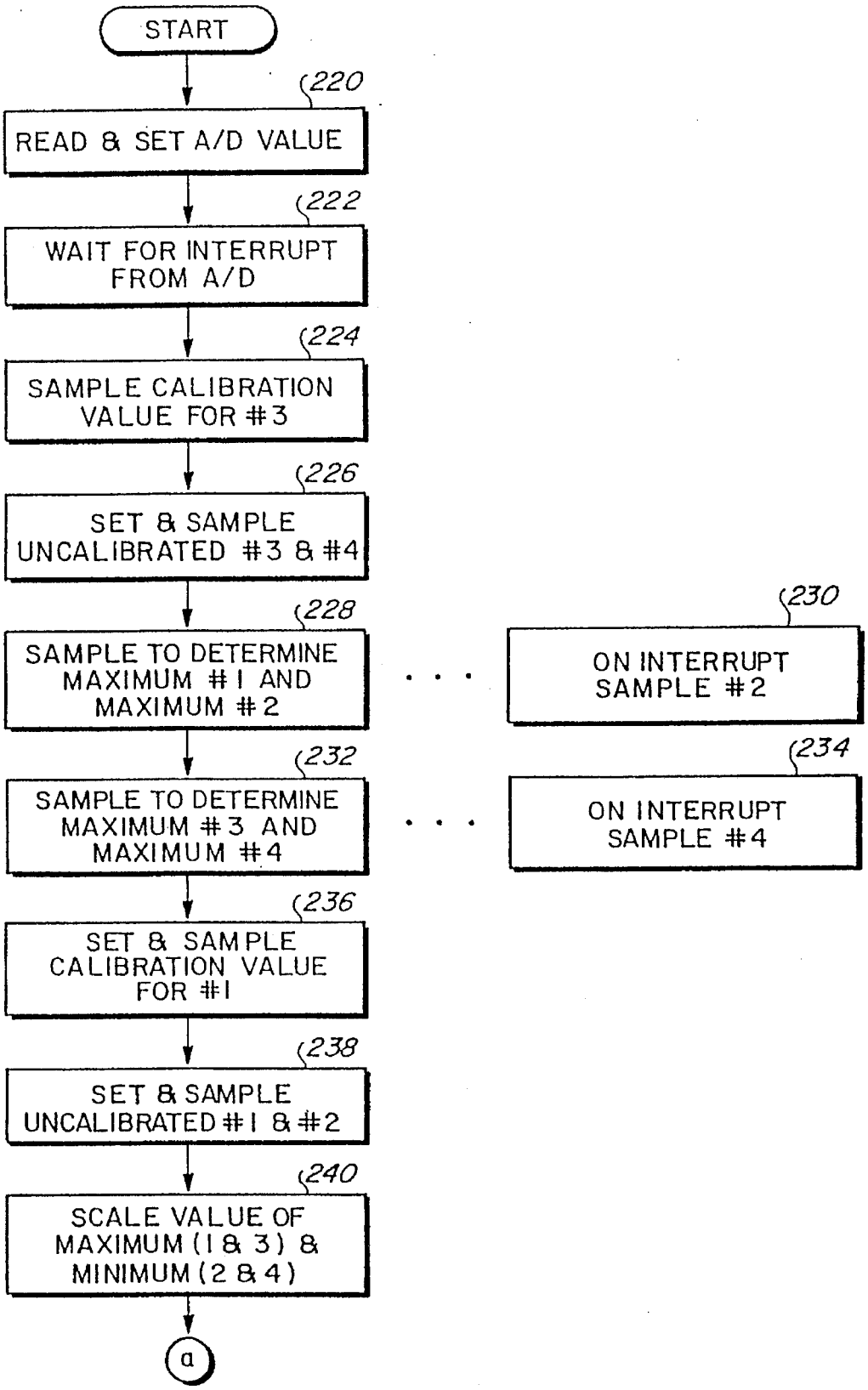
FIG. 6 is a flow diagram of the program used by the processor in the coin detection device shown in FIG. 1 for detecting and calibrating the numeric values of the characteristics of a coin.

Referring to FIG. 6 there is shown the program steps to determine scale values of Characteristics Nos. 1–4 for the electrical signals of induction devices 12 and 14 when coin 22 travels along path 23.

In step 220 processor 58 reads the AMP via A/D converter 68. Processor 58 then increments the value of $D_O$–$D_N$ to force network 130 to place a voltage level on output line 134 that is higher than the voltage level of AMP during steady state, i.e., no coin present condition. The value of $D_O$–$D_N$ is preferably set ten increments above the value that triggers comparator 132 during steady state. Processor 58 then executes step 222.

In step 222, processor 58 waits for a coin to enter induction device 12. When the coin enters induction device 12, the voltage level of AMP increases, triggering interrupt one. When an interrupt one occurs, processor 58 executes step 224.

In step 224, a low voltage signal is fed on calibration control line 82' to oscillator circuit 60 to calibrate Characteristic No. 3. The amplitude of the AMP signal corresponding to a calibration Characteristic No. 3 is read on the data lines coupled to A/D converter circuit 68'. Processor 58 then executes step 226.

In step 226 the calibration control line 82' is set to high, the voltage level of AMP corresponding to Characteristic No. 3 is read from A/D converter circuit 68' and the frequency of FREQ', corresponding to Characteristic No. 4, is read from frequency detector circuit 66' over data lines 74. These read calibrated and uncalibrated values are stored for later recall in step 240. Processor 58 then executes step 228.

In step 228 the maximum value of characteristic No. 1 is determined and the minimum value of characteristic No. 2 is also determined. When a coin is inserted into a slot and passes by induction device 12 the voltage level across resistor 114 (FIG. 3) increases to its maximum value. This maximum value occurs when coin 22 is centered in induction coils 28 and 30. The minimum value of the Characteristic No. 2 occurs also at this point in time.

The value of the frequency for Characteristic No. 2 is read by processor 58 through latch 160. Processor 58 then waits for a second interrupt two from frequency detector circuit 66. When processor 58 receives an interrupt two from D–Q latch 154 in frequency detector circuit 66, processor 58 subtracts the value previously read from latch 160 from the value just read on latch 160. The result of this subtraction is a count corresponding to the relative time between rising edges on the 2 kHz clock. This count is proportional to the frequency on oscillator circuit 60. Processor 58 then executes step 232.

In step 232 processor 58 computes the minimum value of Characteristic No. 4 and the maximum value of Characteristic No. 3. Characteristic No. 3 is obtained by reading values from A/D converter circuit 68' and Characteristic No. 4 is obtained by reading frequency detector circuit 66'. Processor 58 then executes step 234.

In step 234 interrupt two is provided from frequency detector circuit 66' indicating the next rising edge from the aforementioned 2 kHz clock. Processor 58 then computes the count corresponding to the relative time between rising edges of the 2 kHz clock as described in step 230. Processor 58 then executes step 236.

In step 236 the calibration control line 82 is set with a low voltage and Characteristic No. 1 is read from oscillator logic 16. Processor 58 then executes step 238.

In step 238 processor 58 sets calibration control line 82 to a high voltage and reads the uncalibrated Characteristics No. 1 and No. 2. Step 240 is then executed.

In step 240 the maximum value of Characteristic No. 1 and Characteristic No. 3 and the minimum value of Characteristic No. 2 and Characteristic No. 4 are scaled based upon the calibration values read in steps 236 and 224 and the uncalibrated values read in steps 238 and 226. Characteristic No. 1 and Characteristic No. 3 are scaled using the ratio of the difference between the maximum reading and the uncalibrated reading to the difference between the calibrated reading and the uncalibrated reading as follows: (Maximum Reading—Uncalibrated Reading)/(Calibrated Reading—Uncalibrated Reading). The minimum values for Characteristic No. 2 and Characteristic No. 4 are scaled using a percent change from the uncalibrated reading as follows: (Uncalibrated Reading—Minimum Reading)/Uncalibrated Reading. These results are referred to as scaled characteristics. Once processor 58 completes the calibration and coin measurement routines, the coin type is computed in steps 242 through 264, shown in FIG. 7.

In the embodiment discussed above wherein Characteristics Nos. 5 and 6 are determined as functions of the time rate of change of Characteristics Nos. 1 and 3, scaling is accomplished for Characteristics Nos. 5 and 6 in similar fashion to that for Characteristics Nos. 1 and 3.

Figure 7:
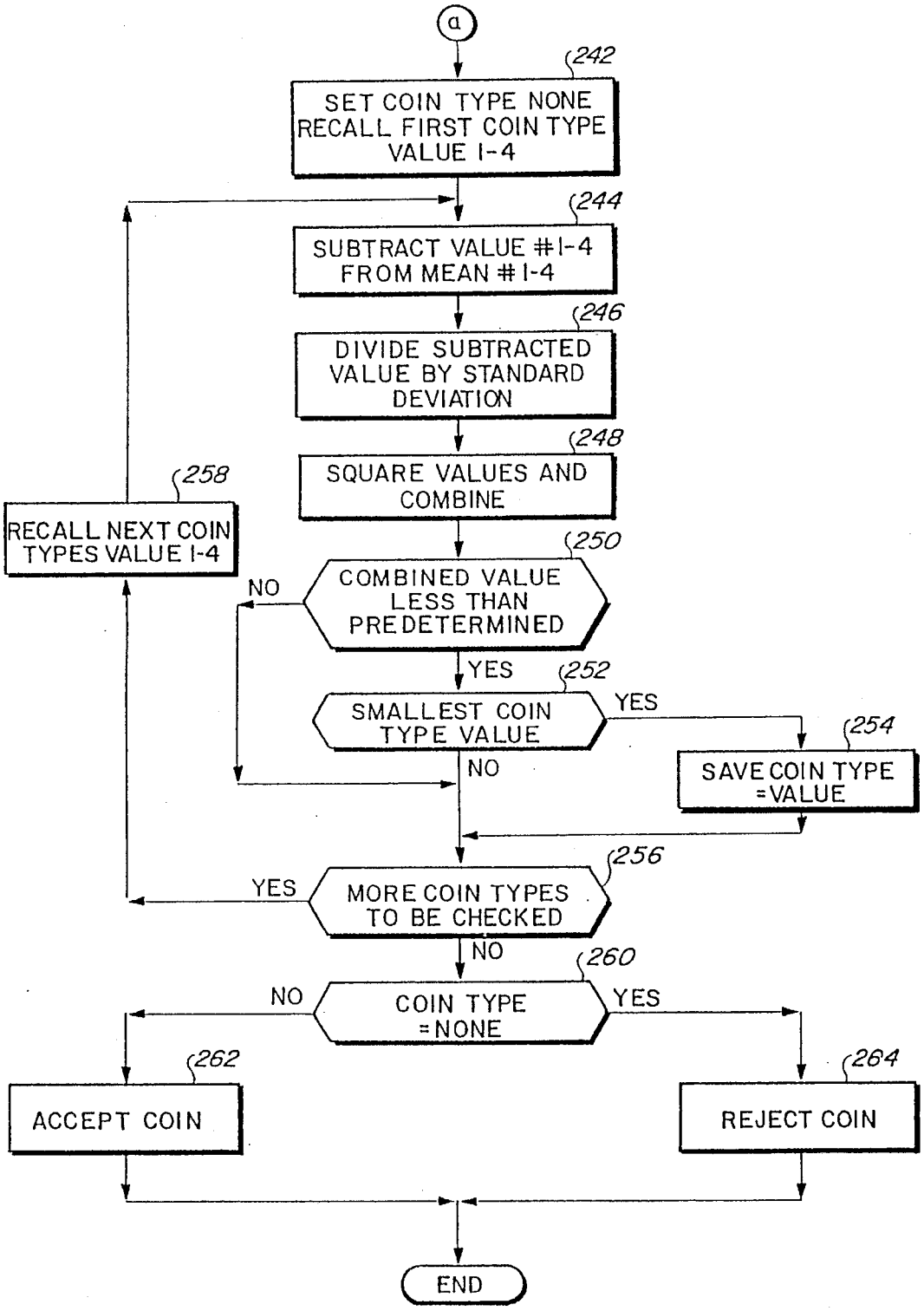
FIG. 7 is a flow diagram of the program used by the processor for determining whether or not the detected coin is acceptable, and if acceptable, the value of the coin.

Referring to FIG. 7 in step 242, a coin type is initially set to "none." The mean and standard deviation values for Characteristics Nos. 1 through 4 for a first coin type, i.e., a U.S. five-cent piece, is retrieved from memory 20. Step 244 is then executed.

In step 244 each of Characteristics Nos. 1 through 4 are individually subtracted from the respective mean for Characteristics Nos. 1 through 4 for the respective coin type to obtain a differential value. For example, assume that a U.S. five-cent coin, is the first coin type having a variable to be retrieved from memory 20. Processor 58 subtracts the mean value for Characteristic No. 1 for the five-cent coin from scaled Characteristic No. 1, and then subtracts the mean value for Characteristic No. 2 for the five-cent coin from the scaled Characteristic No. 2, and so on until all differential values have been computed. Step 246 is then executed.

In step 246 the differential value for each of the Characteristics Nos. 1 through 4 is divided by their respective standard deviations variable retrieved from memory 20 for the current coin type. Processor 58 then executes step 248.

In step 248, the results of the division in step 246 are squared and then summed. The square root of the sum is then computed to determine a combined differential value, also referred to as a statistical variation. Processor 58 then executes step 250.

In step 250 the combined differential value is compared with a predetermined value. The predetermined value is selected to limit the range of acceptabilities. The higher the predetermined value, the broader the range of acceptability of coins that will be allowed. The smaller the predetermined value, the higher the probability that an acceptable coin will be rejected. The preferred value for the predetermined value is set to five to allow for errors due to noise, repeatability, and component aging. Processor 58 compares the combined differential value to the predetermined value. If the combined differential value is less than the predetermined value, processor 58 executes step 252. If the combined differential value is not less than the predetermined value, processor 58 executes step 256.

In step 252 processor 58 determines if this combined differential value is the smallest combined differential value computed so far. If this combined value is the smallest combined differential value, processor 58 executes step 254. However, if the combined differential value that was just determined is not the smallest combined differential value, then processor 58 executes step 256.

In step 254 processor 58 saves the current coin type with its respective value. Processor 58 then executes step 256.

In step 256 processor 58 determines if all the coin types have been compared with the sample. If all the coin types have not been compared and there are still more coin types that must be sampled, processor 58 executes step 258. If all the coin types have been compared with the sample coin, processor 58 falls through to step 260. In this example only the five-cent coin type has been checked so far and accordingly processor 58 executes step 258.

In step 258 the next coin type and its associated values for Characteristics Nos. 1 through 4 are recalled from memory 20. Processor 58 then executes steps 244 through 254 to determine whether the characteristics of the sample coin has characteristics closer to another coin type.

In step 260 processor 58 determines whether a coin type value has been set or whether a coin type value remains set to "none," as was set in step 242. If the coin type value is set to "none," processor 58 executes step 264 where a rejection signal is sent to the machine resulting in the coin to be discharged. However, if the coin type is set to a value, processor 58 notes the value and provides a signal in step 262 to accept the coin.

In step 262 the coin is accepted and a signal is sent to the proper machinery or other electronic computer equipment providing an indication of this acceptance. After executing step 262 or 264, processor 58 waits for a new coin to be detected before executing step 220 and repeating this process.

The formula for computing whether the coin is acceptable can be summarized as follows:

$$R = \frac{(V_{c1} - M_{c1})^2}{Std_{c1}} + \frac{(V_{c2} - M_{c2})^2}{Std_{c2}} + \frac{(V_{c3} - M_{c3})^2}{Std_{c3}} + \frac{(V_{c4} - M_{c4})^{2\ 1/2}}{Std_{c4}}$$

where R is the result, referred to as a combined differential value or statistical variation;

$V_{c1}$–$V_{c4}$ are the scaled values for Characteristics Nos. 1–4;

$M_{c1}$–$M_{c4}$ are the mean values for Characteristics Nos. 1–4; and $Std_{c1}$–$Std_{c4}$ are the standard deviation for Characteristics Nos. 1–4.

Also when R≦the Predetermined Value (or range), the coin is accepted for the smallest value of R; and when R> the Predetermined Value, the coin is rejected. It is recognized that by determining acceptability of a coin using statistical functions, the probability of slug acceptance is reduced.

For the alternate embodiment discussed above wherein Characteristics Nos. 5 and 6 are determined, the procedure in FIGS. 6 and 7 are performed including these characteristics. The equation above then takes the form:

$$R' = \frac{(V_{c1}-M_{c1})^2}{Std_{c1}} + \frac{(V_{c2}-M_{c2})^2}{Std_{c2}} + \frac{(V_{c3}-M_{c3})^2}{Std_{c3}} + \frac{(V_{c4}-M_{c4})^2}{Std_{c4}} \frac{(V_{c5}-M_{c5})^2}{Std_{c5}} + \frac{(V_{c6}-M_{c6})^{2\ 1/2}}{Std_{c6}}$$

where R' is the result, referred to as a combined differential value or statistical variation;

$V_{c1}$–$V_{c6}$ are the scaled values for Characteristics Nos. 1–6;

$M_{c1}$–$M_{c6}$ are the mean values for Characteristics Nos. 1–6; and $Std_{c1}$–$Std_{c6}$ are the standard deviation for Characteristics Nos. 1–6.

This concludes the description of the preferred embodiments. A reading by those skilled in the art will bring to mind various changes without departing from the spirit and scope of the invention. It is intended, however, that the invention only be limited by the following appended claims.

What is claimed is:

1. A coin detection method comprising the steps of:

establishing a magnetic flux across a coin path by providing an oscillating signal;

passing a coin under test along the path;

detecting the change in energy loss caused by the movement of the coin under test along the path;

utilizing the change for the detection of an amplitude characteristic of the coin under test;

determining the change of the amplitude characteristic with time of the coin under test;

storing into memory a statistical variable determined from measurements of the amplitude-time characteristics of a plurality of coins of the same type as the coin under test;

determining for the coin under test a deviation value in relation to the stored statistical variable; and providing a signal indicating acceptability of the coin under test if the deviation value is within a predetermined acceptable range.

2. A coin detection method comprising the steps of:

establishing a magnetic flux across a coin path by providing an oscillating signal;

passing a coin under test along the path;

detecting both the change in inductance and the change in energy loss caused by the movement of the coin under test along the path;

utilizing both changes for the detection of plural predetermined characteristics of the coin under test;

determining the time rate of change of at least one predetermined characteristic of the coin under test;

storing into memory statistical variables determined from measurements of the time rate of change of the at least one predetermined characteristic of a plurality of coins of the same type as the coin under test;

determining for the coin under test a deviation value in relation to all of the stored statistical variables; and providing a signal indicating acceptability of the coin under test if the deviation value is within a predetermined acceptable range.

3. A coin detection method comprising the steps of:

establishing a magnetic flux across a coin path with the use of an oscillation signal provided to an induction coil, the coil having a surface extending along the path, the surface being disposed adjacent the path such that when the coin travels along the path the coin passes adjacent the coil;

passing a coin under test along the path;

providing an altered oscillation signal in response to the effect of a coin passing adjacent the inductor coil;

sensing the amplitude of the altered oscillation signal as a function of time;

storing into a memory statistical variables determined from measurements of the amplitude-time characteristics of a plurality of coins of the same type as the coin under test;

determining for the coin under test a deviation value in relation to the stored statistical variables;

comparing the deviation Value with a predetermined statistical value; and accepting the coin under test if the deviation value is less than the predetermined statistical value.

4. A method of determining whether or not a coin being sampled is acceptable, the method comprising the steps of:

establishing a magnetic flux across a coin path with the use of an oscillation signal provided to an induction coil, the coil having a surface extending along the path, the surface being disposed adjacent the path such that when the coin travels along the path the coin passes adjacent the coil;

passing a coin being sampled along the path;

providing an altered oscillation signal in response to the effect of a coin passing adjacent the inductor coil;

sensing the amplitude of the altered oscillation signal as a function of time;

storing into a memory statistical variables determined from measurements of the amplitude-time characteristics of a plurality of coins of the same type as the coin being sampled;

determining for the coin being sampled a deviation value in relation to the stored statistical variables; and providing an indication that the coin being sampled is acceptable if the deviation value is within a predetermined range.

* * * * *